US011378101B2

(12) United States Patent
Yamamoto

(10) Patent No.: US 11,378,101 B2
(45) Date of Patent: Jul. 5, 2022

(54) SHOVEL

(71) Applicant: SUMITOMO CONSTRUCTION MACHINERY CO., LTD., Tokyo (JP)

(72) Inventor: Takashi Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/750,195

(22) Filed: Jan. 23, 2020

(65) Prior Publication Data

US 2020/0157764 A1 May 21, 2020

Related U.S. Application Data

(63) Continuation of application No. PCT/JP2018/027975, filed on Jul. 25, 2018.

(30) Foreign Application Priority Data

Jul. 27, 2017 (JP) ..... JP2017-145751

(51) Int. Cl.
*F15B 11/042* (2006.01)

(52) U.S. Cl.
CPC ..... *F15B 11/042* (2013.01); *F15B 11/0423* (2013.01); *F15B 2211/275* (2013.01)

(58) Field of Classification Search
CPC ..... F15B 11/0423; F15B 11/042; F15B 2211/275
See application file for complete search history.

(56) References Cited

U.S. PATENT DOCUMENTS 4,534,268 A * 8/1985 Yagyu ..... F15B 11/17 91/6
5,692,377 A * 12/1997 Moriya ..... E02F 9/2242 60/421
6,378,303 B1 * 4/2002 Higuchi ..... F15B 11/042 60/468
2007/0101708 A1 5/2007 Ohigashi et al.
2009/0218112 A1 9/2009 Mintah et al.
2015/0114731 A1 4/2015 Tsukamoto
2015/0252819 A1 9/2015 Imura et al.
2015/0300378 A1 10/2015 Udagawa et al.
(Continued)

FOREIGN PATENT DOCUMENTS

JP H1 1-303809 11/1999
JP 2007-333017 12/2007
(Continued)

OTHER PUBLICATIONS

International Search Report for PCT/JP2018/027975 dated Sep. 4, 2018.

*Primary Examiner* — F Daniel Lopez
(74) *Attorney, Agent, or Firm* — IPUSA, PLLC

(57) ABSTRACT

A shovel according to an embodiment of the present invention includes a lower traveling body, an upper turning body pivotally mounted on the lower traveling body, a hydraulic pump mounted on the upper turning body, a hydraulic actuator driven by hydraulic oil discharged from the hydraulic pump, an operating device used to operate the actuator, and a control device configured to control an acceleration/deceleration characteristic of the hydraulic actuator in response to an operation of the operating device depending on a work mode.

7 Claims, 13 Drawing Sheets

(56) References Cited

U.S. PATENT DOCUMENTS

| | | | | |
|---|---|---|---|---|
| 2016/0145835 | A1* | 5/2016 | Kim | E02F 9/26 60/327 |
| 2018/0305899 | A1* | 10/2018 | Kawaguchi | E02F 9/2296 |

FOREIGN PATENT DOCUMENTS

| | | |
|---|---|---|
| JP | 5886976 | 3/2016 |
| WO | 2005/056933 | 6/2005 |
| WO | 2014/013910 | 1/2014 |
| WO | 2014/073541 | 5/2014 |

* cited by examiner

SHOVEL

CROSS-REFERENCE TO RELATED APPLICATION

The present application is a continuation application of International Application No. PCT/JP2018/027975 filed on Jul. 25, 2018 and designated the U.S., which is based on and claims priority to Japanese Patent Application No. 2017-145751 filed with the Japanese Patent Office on Jul. 27, 2017, the entire contents of which are hereby incorporated by reference.

BACKGROUND OF THE INVENTION

1. Field of the Invention

The present invention relates to a shovel.

2. Description of the Related Art

Conventionally, a shovel is known in which a hydraulic actuator is operated by switching to various work modes by changing an engine speed depending on work contents and controlling a discharge pressure and a discharge amount of a hydraulic pump. The work modes include an SP mode that is selected when the work amount is to be most prioritized, and an A mode that is selected when the shovel is to be operated at a low speed and a low noise while prioritizing fuel efficiency.

However, because the above-described shovel changes the maximum operating speed by switching the engine speed for each work mode, responsiveness and acceleration/deceleration characteristics in response to the operation of the operating device in the SP mode and the A mode are the same.

Hence, for example, even when an operator selects the A mode to move the shovel carefully for work requiring accuracy and safety, the same rapid movement as that of the SP mode is performed. This does not follow the operator's intention and is likely to make the operator feel tired.

SUMMARY OF THE INVENTION

One embodiment of the present disclosure is intended to provide a shovel capable of controlling the acceleration/deceleration characteristics depending on the work mode.

A shovel according to an embodiment of the present invention includes a lower traveling body, an upper turning body pivotally mounted on the lower traveling body, a hydraulic pump mounted on the upper turning body, a hydraulic actuator driven by hydraulic oil discharged from the hydraulic pump, an operating device used to operate the actuator, and a control device configured to control an acceleration/deceleration characteristics of the hydraulic actuator in response to an operation of the operating device depending on a work mode.

EMBODIMENTS FOR CARRYING OUT THE INVENTION

Figure 1:
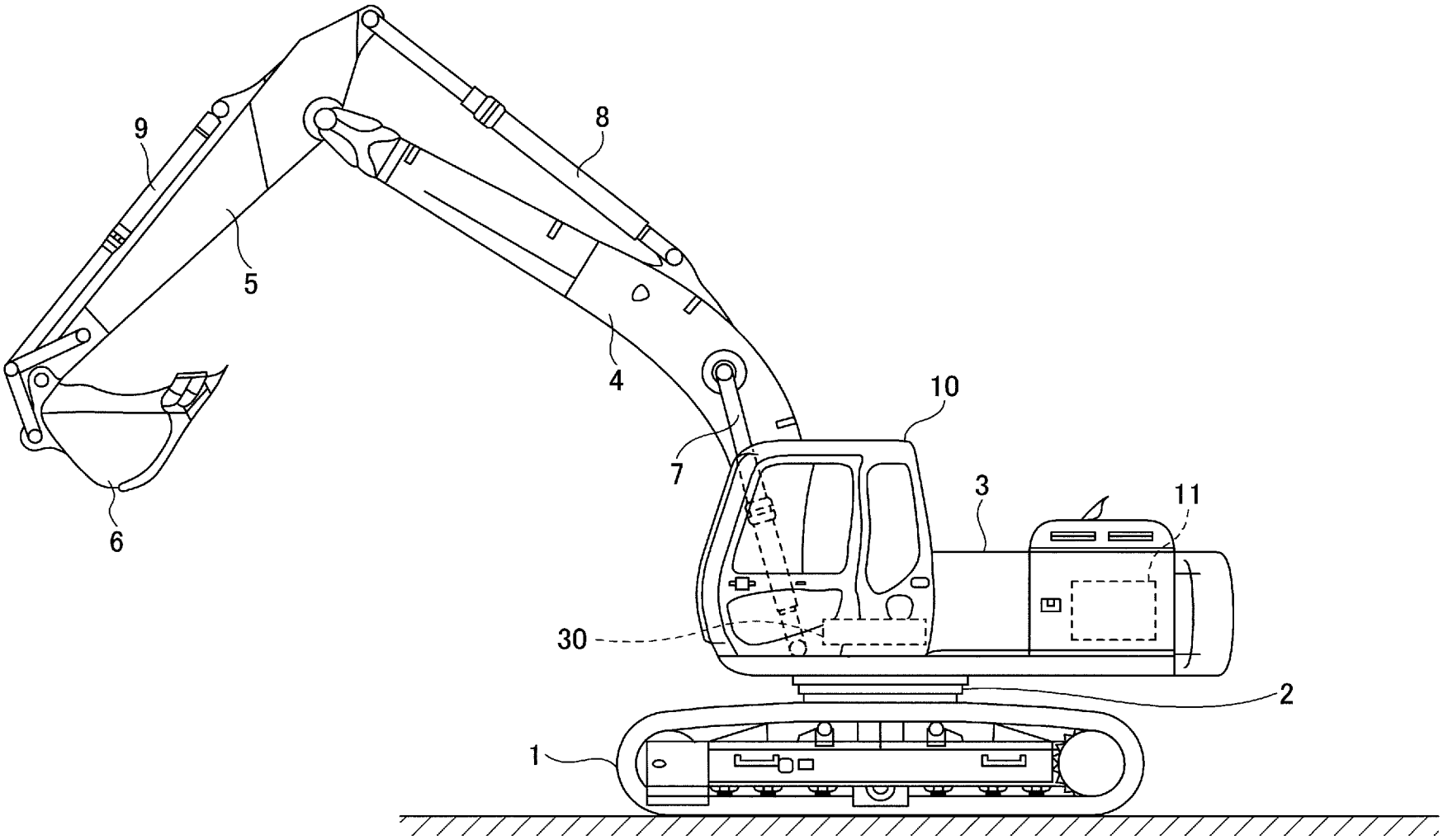
FIG. 1 is a lateral view of a shovel according to an embodiment of the present invention.

Hereinafter, embodiments for carrying out the invention with reference to the drawings will be described. In each drawing, the same components are indicated by the same reference numerals and overlapping descriptions may be omitted.

First, an overall configuration of a shovel according to an embodiment of the present invention will be described with reference to FIG. 1. FIG. 1 is a lateral view of a shovel (excavator) according to an embodiment of the present invention.

As illustrated in FIG. 1, an upper turning body 3 is pivotally mounted on a lower traveling body 1 of the shovel via a turning mechanism 2. A boom 4 is attached to the upper turning body 3. An arm 5 is attached to a distal end of the boom 4, and a bucket 6 as an end attachment is attached to the distal end of the arm 5. The boom 4, the arm 5, and the bucket 6 constitute an excavating attachment as an example of an attachment and are hydraulically driven by a boom cylinder 7, an arm cylinder 8, and a bucket cylinder 9, respectively. The upper turning body 3 includes a cabin 10 that is an operator's cab, and a power source such as an engine 11 is mounted thereon.

A controller 30 is provided within the cabin 10. The controller 30 serves as a main control unit for controlling the driving of the shovel. In this embodiment, the controller 30 is comprised of a computer including a CPU, RAM, ROM, and the like. Various functions of the controller 30 are implemented, for example, by executing a program stored in a ROM by a CPU.

Figure 2:
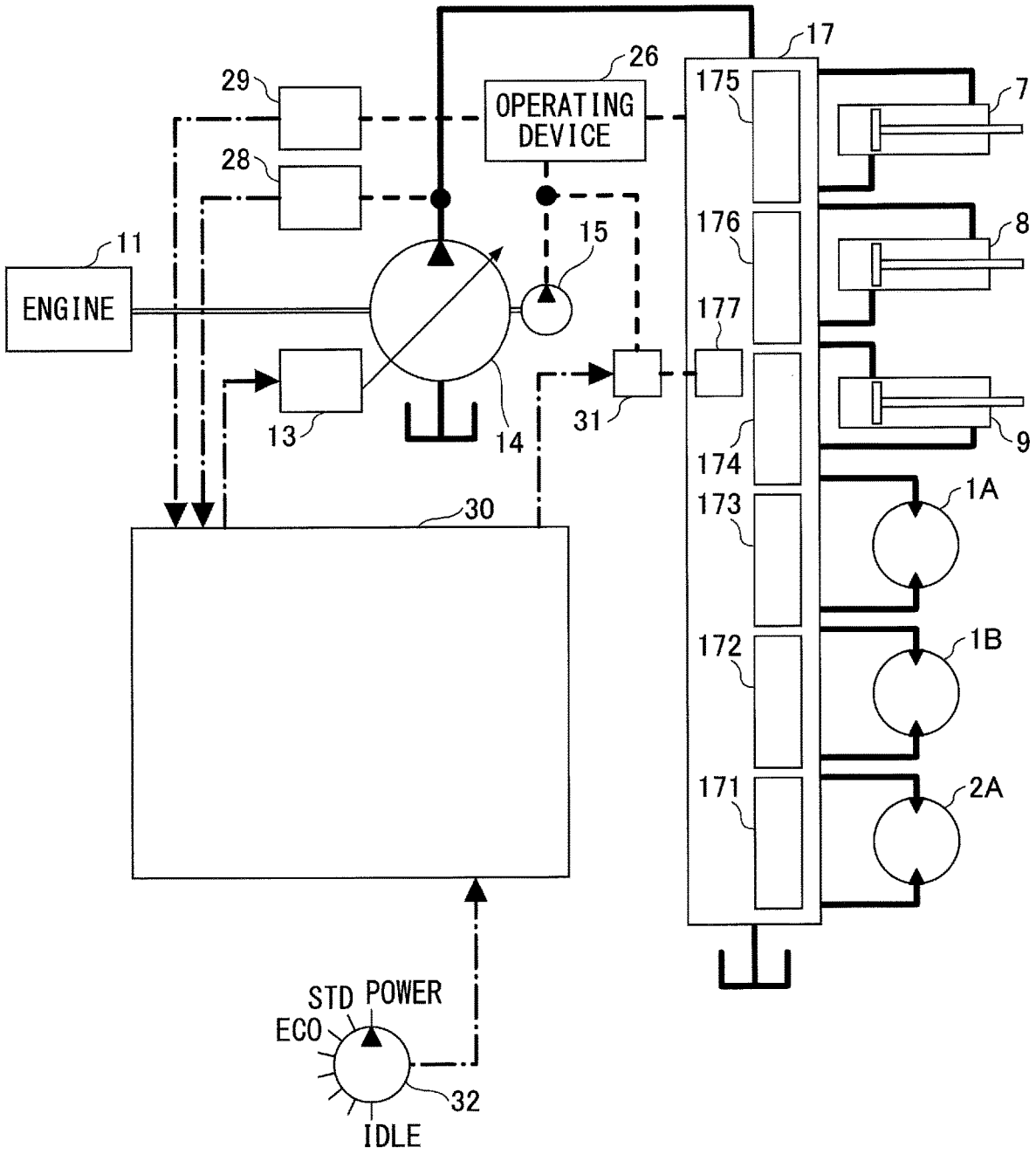
FIG. 2 is a block diagram illustrating an example of a configuration of a driving system of a shovel in FIG. 1.

Next, a configuration of the driving system of the shovel of FIG. 1 will be described with reference to FIG. 2. FIG. 2 is a block diagram illustrating an example of a configuration of a drive system of a shovel in FIG. 1. In FIG. 2, a mechanical power system, a high pressure hydraulic line, a pilot line, and an electrical control system are shown by double, solid, dashed, and dotted lines, respectively.

As illustrated in FIG. 2, the drive system of the shovel primarily includes an engine 11, a regulator 13, a main pump 14, a pilot pump 15, a control valve 17, an operating device 26, a discharge pressure sensor 28, an operation pressure sensor 29, a controller 30, a proportional valve 31, a work mode selection dial 32, and the like.

The engine 11 is a drive source of the shovel. In the present embodiment, the engine 11 is, for example, a diesel engine that operates to maintain a predetermined rotational speed. An output shaft of the engine 11 is also coupled to an input shaft of the main pump 14 and the pilot pump 15.

The main pump 14 supplies hydraulic oil to the control valve 17 via a high pressure hydraulic line. In the present embodiment, the main pump 14 is a swash plate variable displacement hydraulic pump.

The regulator 13 controls the discharge amount of the main pump 14. In the present embodiment, the regulator 13 controls the discharge amount of the main pump 14 by adjusting a tilt angle of the swash plate of the main pump 14 in response to a control command from the controller 30.

The pilot pump 15 supplies hydraulic oil to various hydraulic control devices including the operating device 26 and the proportional valve 31 through the pilot line. In this embodiment, the pilot pump 15 is a fixed capacitive type hydraulic pump.

The control valve 17 is a hydraulic controller that controls the hydraulic system in the shovel. The control valve 17 includes control valves 171 to 176 and a bleed valve 177. The control valve 17 may selectively supply the hydraulic oil discharged from the main pump 14 to one or more hydraulic actuators through the control valves 171 to 176. The control valves 171 to 176 control the flow of hydraulic oil from the main pump 14 to the hydraulic actuator and the flow of hydraulic oil from the hydraulic actuator to the hydraulic oil tank. The hydraulic actuators include the boom cylinder 7, the arm cylinder 8, the bucket cylinder 9, a left-side traveling hydraulic motor 1A, a right-side traveling hydraulic motor 1B, and a turning hydraulic motor 2A. The bleed valve 177 controls the flow rate (hereinafter, referred to as a "bleed flow rate") of the hydraulic oil discharged from the main pump 14 to the hydraulic oil tank without passing through the hydraulic actuator. The bleed valve 177 may be located outside the control valve 17.

The operating device 26 is a device used by an operator for operation of the hydraulic actuator. In the present embodiment, the operating device 26 supplies the hydraulic oil discharged from the pilot pump 15 to the pilot ports of the control valves corresponding to the respective hydraulic actuators through the pilot lines. The pressure (pilot pressure) of the hydraulic oil supplied to each of the pilot ports is the pressure corresponding to a direction and an amount of operation of the levers or pedals (not illustrated) of the operating device 26 corresponding to each of the hydraulic actuators.

The discharge pressure sensor 28 detects the discharge pressure of the main pump 14. In the present embodiment, the discharge pressure sensor 28 outputs the detected value to the controller 30.

The operation pressure sensor 29 detects the operator's operation content using the operation device 26. In the present embodiment, the operation pressure sensor 29 detects the operation direction and the amount of the operation of the lever or pedal of the operating device 26 corresponding to each of the hydraulic actuators in a form of pressure (operating pressure), and outputs the detected value to the controller 30. The operation content of the operating device 26 may be detected using other sensors other than the operating pressure sensor.

The proportional valve 31 operates in response to a control command output by the controller 30. In the present embodiment, the proportional valve 31 is a solenoid valve that adjusts a secondary pressure introduced from the pilot pump 15 to the pilot port of the bleed valve 177 within the control valve 17 in response to a current command output by the controller 30. The proportional valve 31 operates, for example, to increase the secondary pressure introduced into the pilot port of the bleed valve 177 as the current command increases.

The work mode selection dial 32 is a dial for the operator to select the work mode, and enables the switching of multiple different work modes. Further, from the work mode selection dial 32, data indicating a setting state of the engine speed and a setting state of the acceleration/deceleration characteristics depending on the work mode are always transmitted to the controller 30. The work mode selection dial 32 allows switching of the work modes at multiple stages, including a POWER mode, a STD mode, an ECO mode, and an IDLE mode. The POWER mode is an example of the first mode, and the ECO mode is an example of the second mode. FIG. 2 illustrates a state in which the POWER mode is selected by the work mode selection dial 32.

The POWER mode is an operation mode selected when the workload is to be prioritized, using the highest engine RPM and the highest acceleration/deceleration characteristic. The STD mode is an operation mode selected to achieve both work and fuel efficiency while using the second highest engine RPM and the second highest acceleration/deceleration characteristic. The ECO mode is an operation mode selected to slow down the acceleration/deceleration characteristic of the hydraulic actuator corresponding to the lever operation, to improve accuracy of operation and safety, to operate the shovel with a low noise, to use the third highest engine RPM, and to use the third highest acceleration/deceleration characteristic. The IDLE mode is an operation mode selected when it is intended to idle the engine, utilizing the lowest engine speed and the lowest acceleration/deceleration characteristic. The engine 11 is constantly controlled by the engine speed of the work mode set by the work mode selection dial 32. The opening of the bleed valve 177 is controlled based on the bleed valve opening characteristics of the work mode set by the work mode selection dial 32. The opening characteristics of the bleed valve are described later.

In a configuration diagram of FIG. 2, the ECO mode is set to one of the modes selected by the work mode selection dial 32. However, an ECO mode switch may be provided separately from the work mode selection dial 32. In this case, the operation mode selection dial 32 may be used to adjust the engine RPM corresponding to each selected mode, and when the ECO mode switch is turned ON, the acceleration/deceleration characteristics corresponding to each mode of the operation mode selection dial 32 may be gradually changed.

Alternatively, the change of the work mode may be implemented by an audio input. In that case, the shovel includes a voice input device for inputting the operator's voice to the controller 30. The controller 30 includes a voice identification unit that identifies the voice input by the voice input device.

As described above, the work mode is selected by a mode selection unit such as the work mode selection dial 32, the ECO mode switch, and the voice identification unit.

Figure 3:
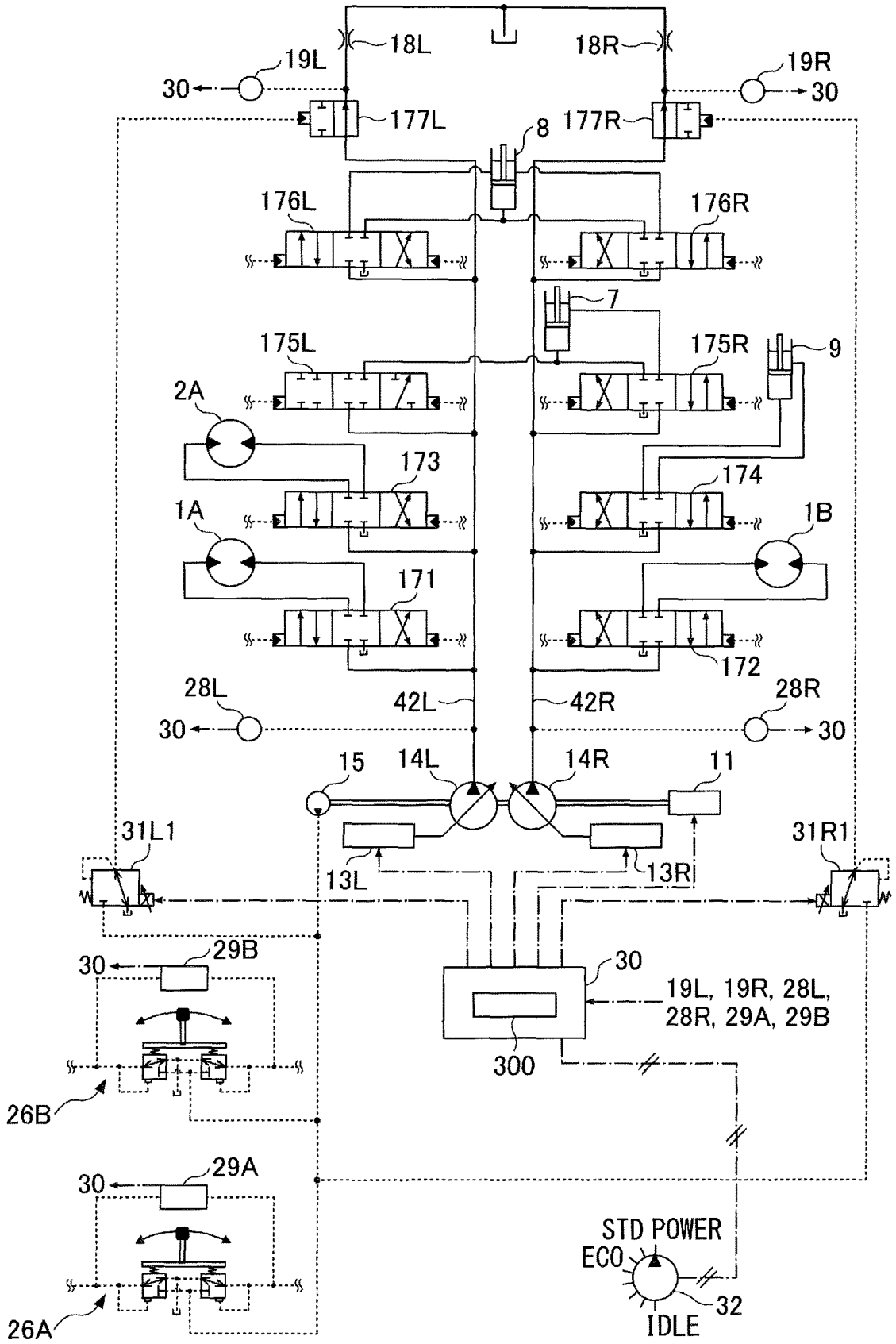
FIG. 3 is a schematic diagram illustrating a first configuration example of a hydraulic circuit mounted on a shovel of FIG. 1.

Next, a configuration example of a hydraulic circuit mounted on a shovel will be described with reference to FIG. 3. FIG. 3 is a schematic diagram illustrating an example of a configuration of a hydraulic circuit mounted on a shovel of FIG. 1. FIG. 3, similar to FIG. 2, illustrates a mechanical power system, a high pressure hydraulic line, a pilot line, and an electrical control system, respectively, by double, thick, dashed, and single dashed lines.

The hydraulic circuit of FIG. 3 circulates the hydraulic oil from main pumps 14L and 14R driven by the engine 11 to the hydraulic oil tank through conduits 42L and 42R. The main pumps 14L and 14R correspond to the main pump 14 of FIG. 2.

The conduit 42L is a high pressure hydraulic line connecting the control valves 171, 173, 175L and 176L disposed within the control valve 17 in parallel between the main pump 14L and the hydraulic oil tank. The conduit 42R is a high pressure hydraulic line connecting the control valves 172, 174, 175R and 176R disposed within the control valve 17 in parallel between the main pump 14R and the hydraulic oil tank.

The control valve 171 is a spool valve that supplies the hydraulic oil discharged from the main pump 14L to the left-side traveling hydraulic motor 1A and switches the flow of hydraulic oil in order to discharge the hydraulic oil discharged from the left-side traveling hydraulic motor 1A to the hydraulic oil tank.

The control valve 172 is a spool valve that supplies the hydraulic oil discharged from the main pump 14R to the right-side traveling hydraulic motor 1B and switches the flow of the hydraulic oil in order to discharge the hydraulic oil discharged from the right-side traveling hydraulic motor 1B to the hydraulic oil tank.

The control valve 173 is a spool valve that supplies the hydraulic oil discharged from the main pump 14L to the turning hydraulic motor 2A and switches the flow of the hydraulic oil in order to discharge the hydraulic oil discharged from the turning hydraulic motor 2A to the hydraulic oil tank.

The control valve 174 is a spool valve to supply the hydraulic oil discharged from the main pump 14R to the bucket cylinder 9 and to discharge the hydraulic oil from the bucket cylinder 9 to the hydraulic oil tank.

The control valves 175L and 175R are spool valves that supply the hydraulic oil discharged from the main pumps 14L and 14R to the boom cylinder 7 and that switch the flow of the hydraulic oil in order to discharge the hydraulic oil in the boom cylinder 7 to the hydraulic oil tank.

The control valves 176L and 176R are spool valves that supply the hydraulic oil discharged from the main pumps 14L and 14R to the arm cylinder 8 and that switch the flow of the hydraulic oil in order to discharge the hydraulic oil in the arm cylinder 8 to the hydraulic oil tank.

The bleed valve 177L is a spool valve that controls the bleed flow rate with respect to the hydraulic oil discharged from the main pump 14L. The bleed valve 177R is a spool valve that controls the bleed flow rate with respect to the hydraulic oil discharged from the main pump 14R. The bleed valves 177L and 177R correspond to the bleed valves 177 of FIG. 2.

The bleed valves 177L and 177R have, for example, a first valve position with a minimum opening area (0% opening) and a second valve position with a maximum opening area (100% opening). The bleed valves 177L and 177R can be moved steplessly between the first and second valve positions.

Regulators 13L and 13R control the discharge amount of the main pumps 14L and 14R by adjusting the tilt angle of the swash plate of the main pumps 14L and 14R. The regulators 13L and 13R correspond to the regulator 13 in FIG. 2. The controller 30 adjusts the tilting angle of the swash plate of the main pumps 14L and 14R with the regulators 13L and 13R in response to an increase in the discharge pressure of the main pumps 14L and 14R to decrease the discharge amount. This is intended cause an absorbed horsepower of the main pump 14, which is expressed as the product of the discharge pressure and the discharge amount, not to exceed the output horsepower of the engine 11.

The arm operation lever 26A is an example of the operating device 26 and is used to operate the arm 5. The arm operation lever 26A utilizes the hydraulic oil discharged from the pilot pump 15 to introduce the control pressure depending on the lever operation amount into the pilot ports of the control valves 176L and 176R. Specifically, the arm operation lever 26A introduces the hydraulic oil to the right pilot port of the control valve 176L and introduces the hydraulic oil to the left pilot port of the control valve 176R when operated in the arm closing direction. The arm operation lever 26A, when operated in the arm opening direction, introduces the hydraulic oil to the left pilot port of the control valve 176L and introduces the hydraulic oil to the right pilot port of the control valve 176R.

The boom operation lever 26B is an example of the operating device 26 and is used to operate the boom 4. The boom operation lever 26B utilizes the hydraulic oil discharged from the pilot pump 15 to introduce the control pressure depending on the amount of lever operation into the pilot ports of the control valves 175L and 175R. Specifically, the boom operating lever 26B introduces hydraulic oil to the right pilot port of the control valve 175L and introduces the hydraulic oil to the left pilot port of the control valve 175R when being operated in the boom raising direction. The boom operation lever 26B, when being operated in the boom lowering direction, introduces the hydraulic oil to the left pilot port of the control valve 175L and introduces the hydraulic oil to the right pilot port of the control valve 175R.

The discharge pressure sensors 28L and 28R are examples of the discharge pressure sensors 28, detect the discharge pressure of the main pumps 14L and 14R, and output the detected value to the controller 30.

The operation pressure sensors 29A and 29B are examples of the operation pressure sensor 29 that detects the operator's operation contents to the arm operation lever 26A and the boom operation lever 26B in a form of pressure and that outputs the detected value to the controller 30. The operation contents are, for example, a lever operation direction, a lever operation amount (lever operation angle), and the like.

The right and left travelling levers (or pedals), the bucket operation lever, and the turning operation lever (neither of which is illustrated in the drawings) are operating devices for controlling the travel of the lower traveling body 1, opening and closing of the bucket 6, and the turn of the upper turning body 3, respectively. These operating devices, like the arm operation levers 26A and the boom operation levers 26B, utilize the hydraulic oil discharged from the pilot pump 15 to introduce a control pressure depending on the lever operation amount (or pedal operation amount) into either the left or right pilot port of the control valve corresponding to each of the hydraulic actuators. The operator's operating contents for each of these operating devices, as well as the operation pressure sensors 29A and 29B, are detected by the corresponding operation pressure sensors in a form of pressure, and a detected value is output to the controller 30.

The controller 30 receives an output, such as one from the operation pressure sensors 29A and 29B, and outputs a control command to the regulators 13L and 13R as needed to change the discharge amount of the main pumps 14L and 14R. If necessary, a current command is output to the proportional valves 31L1 and 31R1 to change the opening area of the bleed valves 177L and 177R.

The proportional valves 31L1 and 31R1 adjust the secondary pressure introduced from the pilot pump 15 to the pilot ports of the bleed valves 177L and 177R in response to a current command output from the controller 30. The proportional valves 31L1, 31R1 correspond to the proportional valves 31 in FIG. 2.

The proportional valve 31L1 can adjust the secondary pressure so that the bleed valve 177L stops at any position between the first and second valve positions. The proportional valve 31R1 can adjust the secondary pressure so that the bleed valve 177R stops at any position between the first valve position and the second valve position.

Next, a negative controlling control (hereinafter, referred to as "negative control") employed in the hydraulic circuit of FIG. 3 will be described.

The conduits 42L and 42R include negative control throttles 18L and 18R arranged between each of the downstream bleed valves 177L and 177R and the hydraulic oil tank. The flow of hydraulic oil through the bleed valves 177L and 177R to the hydraulic oil tank is limited by the negative control throttles 18L and 18R. The negative control throttles 18L and 18R generate a control pressure (hereinafter, referred to as a "negative control pressure") for controlling the regulators 13L and 13R. Negative control pressure sensors 19L and 19R are sensors for detecting a negative control pressure and output detected values to the controller 30.

In the present embodiment, the negative control throttles 18L and 18R are variable apertures in which the opening area varies. The negative control throttles 18L and 18R, however, may be fixed apertures.

The controller 30 controls the discharge amount of the main pumps 14L and 14R by adjusting the tilting angle of the swash plate of the main pumps 14L and 14R depending on the negative control pressure. Hereinafter, the relationship between the negative control pressure and the discharge amount of the main pumps 14L and the 14R is referred to as "negative control characteristics." The negative control characteristics may be stored, for example, as a look-up table in a ROM or the like, or may be represented by a predetermined calculation expression. For example, the controller 30 refers to a table representing predetermined negative control characteristics, and the larger the negative control pressure, the smaller the discharge amount of the main pumps 14L and the 14R, and the smaller the negative control pressure, the larger the discharge amount of the main pumps 14L and the 14R.

Specifically, when none of the hydraulic actuators is operated as illustrated in FIG. 3, the hydraulic oil discharged from the main pumps 14L and 14R passes through the bleed valves 177L and 177R to the negative control throttles 18L and 18R. The flow of hydraulic oil through the bleed valves 177L and 177R increases the negative control pressure generated upstream of the negative control throttles 18L and 18R. As a result, the controller 30 reduces the discharge amount of the main pumps 14L and 14R to a predetermined allowable minimum discharge amount and reduces the pressure loss (pumping loss) when the discharged hydraulic oil passes through the conduits 42L and 42R. This predetermined minimum allowable discharge rate in a standby state is an example of the bleed flow rate, hereinafter referred to as a "standby flow rate."

On the other hand, when any of the hydraulic actuators is operated, the hydraulic oil discharged from the main pumps 14L and 14R flows through a control valve corresponding to the hydraulic actuator of an operation object and flows into the hydraulic actuator of the operation object. Therefore, the bleed flow rate through the bleed valves 177L and 177R to the negative control throttles 18L and 18R is decreased, and the negative control pressure generated upstream of the negative control throttle 18L and 18R is reduced. As a result, the controller 30 increases the discharge rate of the main pumps 14L and 14R, while supplying sufficient hydraulic oil to the hydraulic actuators to be operated, and ensures that the hydraulic actuators to be operated are driven. Hereinafter, the flow rate of hydraulic oil flowing into the hydraulic actuator is referred to as an "actuator flow rate." In this case, the flow rate of the hydraulic oil discharged from the main pumps 14L and 14R is equivalent to the sum of the actuator flow rate and the bleed flow rate.

With the configuration described above, the hydraulic circuit of FIG. 3 can reliably supply a sufficient amount of hydraulic fluid from the main pumps 14L and 14R to the hydraulic actuator to be operated when the hydraulic actuator is operated. In the standby state, waste of hydraulic energy can be reduced. This is because the bleed flow rate can be reduced to the standby flow rate.

In the meantime, in the shovel, by gradually changing the responsiveness and acceleration/deceleration characteristics to the lever operation (or pedal operation) of the operating device 26 depending on the work contents, the operability of the shovel by the operator, the work efficiency of the shovel may be improved; the fatigue of the operator may be reduced; and the safety may be improved. For example, if a hydraulic actuator (boom, arm, bucket, etc.) moves swiftly in response to the lever operation during finishing work such as lever preparation work, a finishing surface may be damaged. In this case, fatigue accumulates in the operator if the lever is operated carefully. Thus, in operations requiring accuracy and safety, it is preferable to have lower responsiveness and/or acceleration/deceleration characteristics to the lever operation (or pedal operation) of the operating device 26. Because the shovel can be moved cautiously (slowly), the hydraulic actuator (boom, arm, bucket, etc.) can be prevented from moving quickly in response to the lever operation. On the other hand, when it is desired to prioritize the amount of work, such as roughing excavation, the responsiveness to the lever operation (or pedal operation) of the operating device 26 and the acceleration/deceleration characteristics are preferably made higher. This is because the shovel can be moved at a high speed.

Conventionally, however, shovels having engine speed adjustment dials for adjusting the engine 11 speed depending on the nature of the work are known, but do not control the responsiveness or acceleration/deceleration characteristics to the lever operation (or pedal operation) of the operating device 26.

Accordingly, in the present embodiment, the acceleration/deceleration characteristic control unit 300 of the controller 30 controls the acceleration/deceleration characteristics of the hydraulic actuator in response to the lever operation (or pedal operation) of the operating device 26 depending on the work mode selected by the work mode selection dial 32. Further, when the ECO mode switch is provided separately from the work mode selection dial 32, the ECO mode switch may be turned ON to relax the acceleration/deceleration characteristics. When a voice input device and a voice identification unit are provided, the acceleration/deceleration characteristic control unit 300 may control the acceleration/deceleration characteristics of the hydraulic actuator in response to the lever operation (or pedal operation) of the operating device 26 depending on the operation mode input from the voice input device and identified by the voice identification unit. This can improve the work efficiency of operators, reduce the fatigue of operators, and improve the safety.

Figure 4:
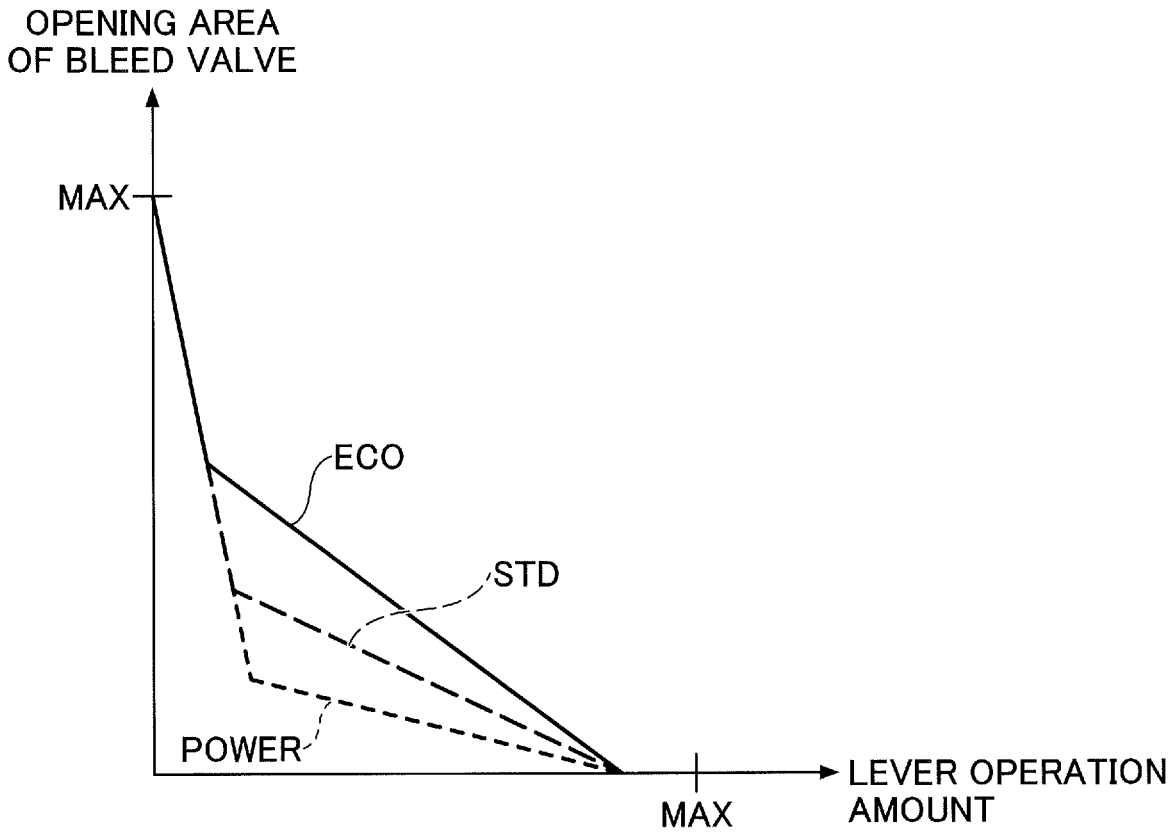
FIG. 4 is a diagram (1) illustrating a relationship between a lever operation amount and an opening area of a bleed valve depending on a work mode.
Figure 5:
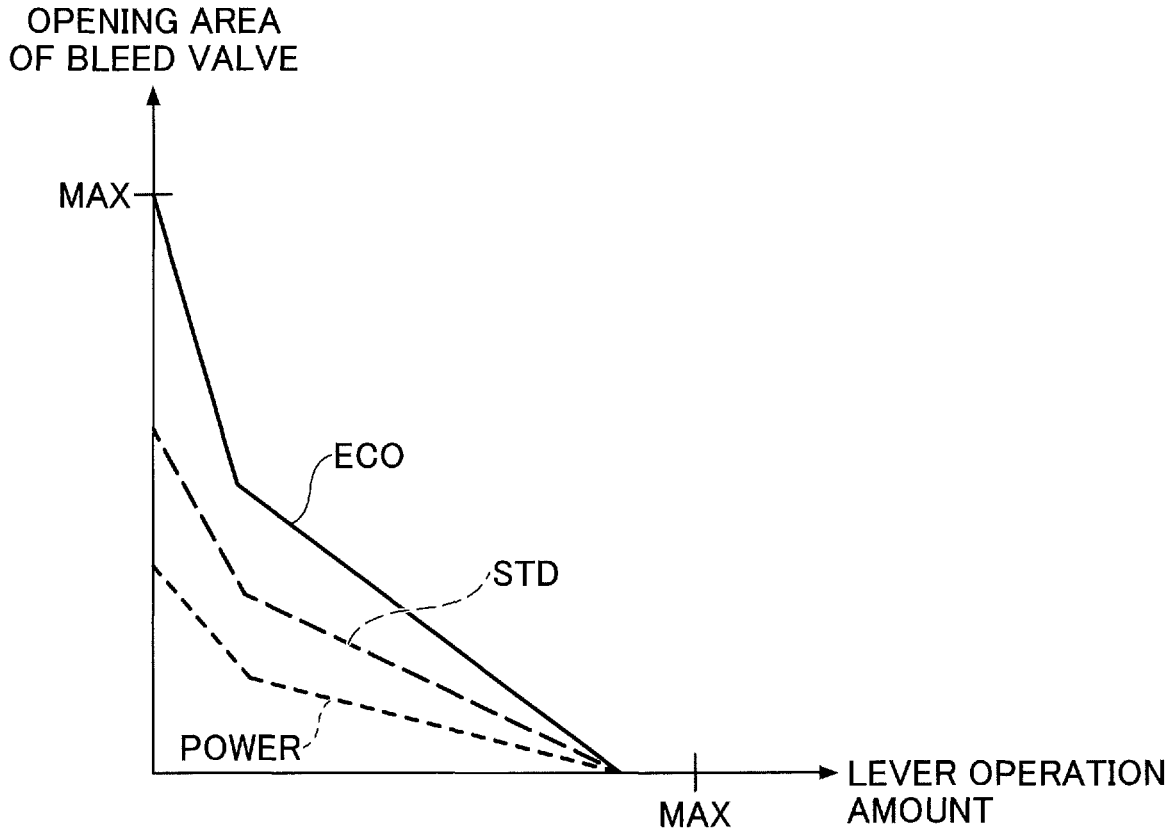
FIG. 5 is a diagram (2) illustrating a relationship between a lever operation amount and an opening area of a bleed valve depending on a work mode.
Figure 6:
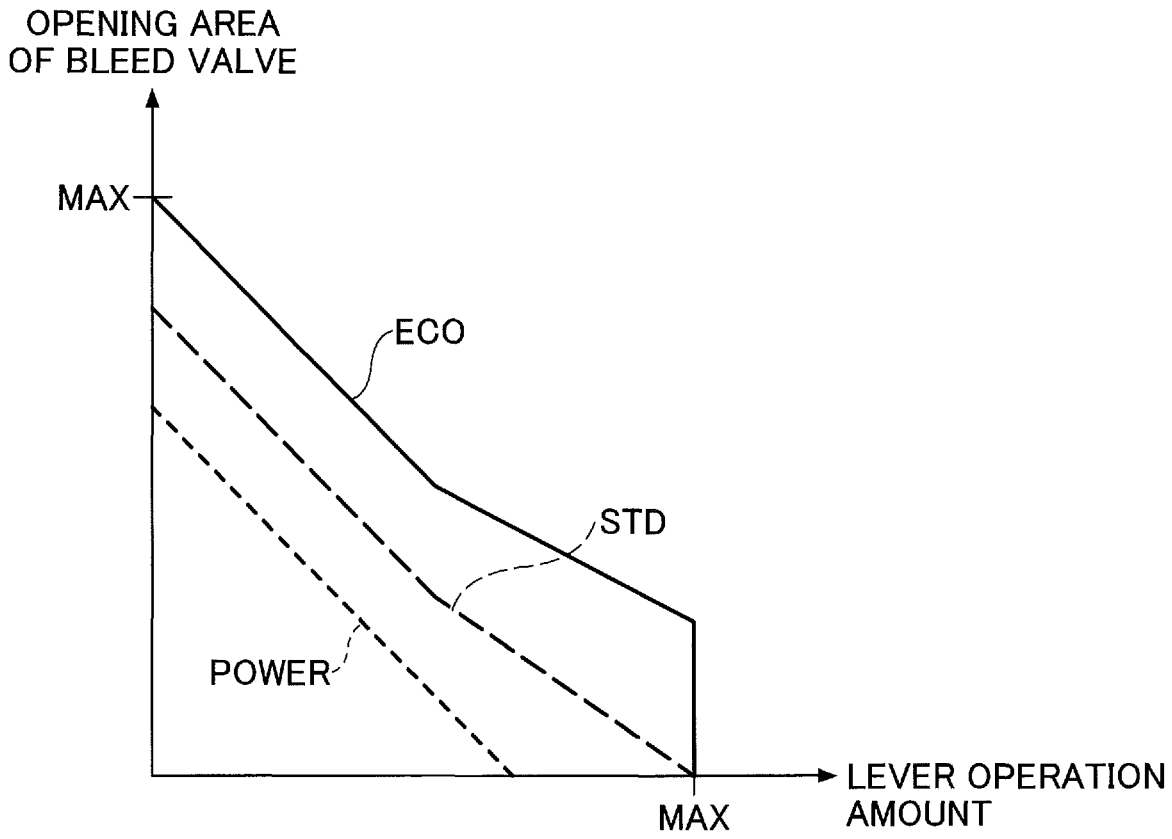
FIG. 6 is a diagram (3) illustrating a relationship between a lever operation amount and an opening area of a bleed valve depending on a work mode.
Figure 7:
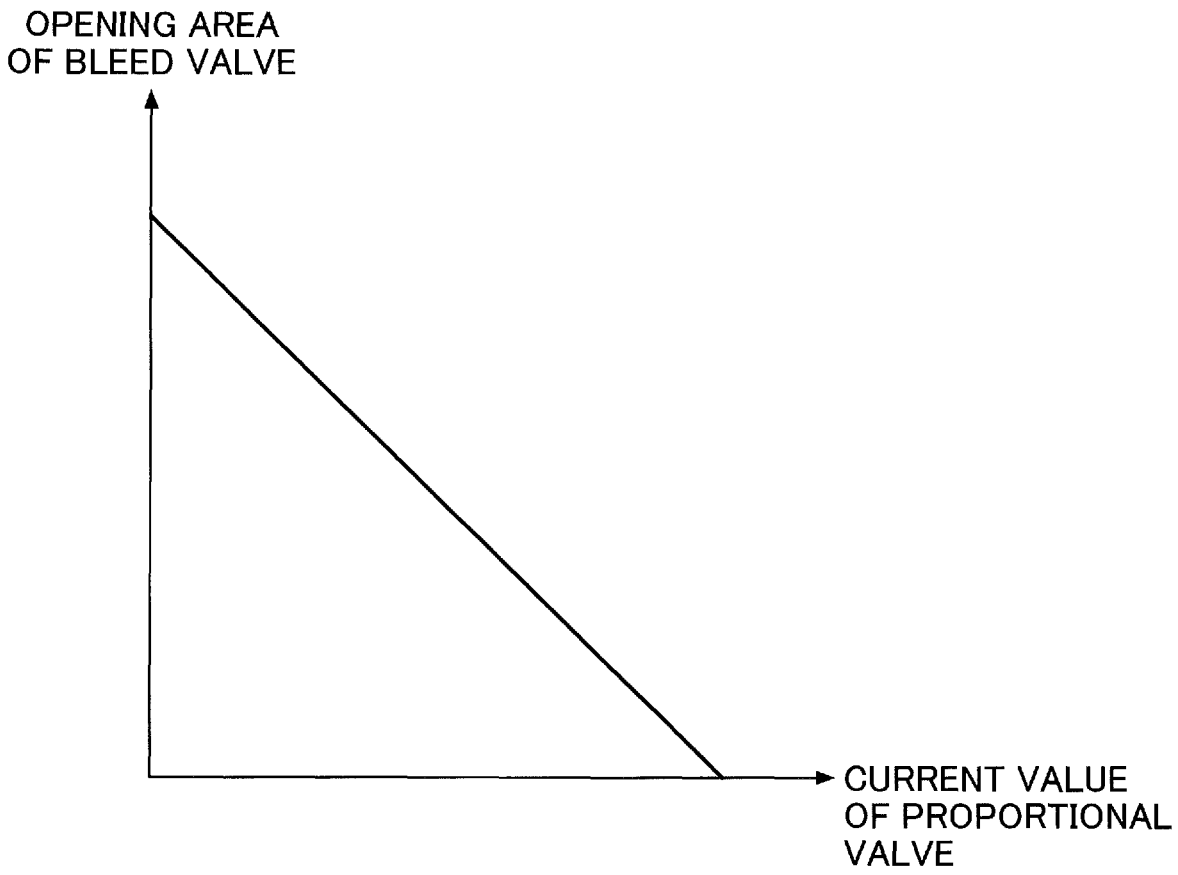
FIG. 7 is a diagram illustrating a relationship between a current value of a proportional valve and an opening area of a bleed valve.

FIGS. 4 to 6 are diagrams illustrating a relationship between a lever operation amount depending on a work mode and an opening area of a bleed valve. FIG. 7 is a diagram illustrating a relationship between a current value of a proportional valve and an opening area of a bleed valve. The relationship between the lever operation amount and the opening area of the bleed valve (hereinafter referred to as "bleed valve opening characteristics") and the relationship between the current value of the proportional valve and the opening area of the bleed valve (hereinafter referred to as "proportional valve characteristics") may be stored in the ROM as a reference table, for example, or may be expressed by a predetermined calculation formula. Further, as will be discussed later in FIG. 11, the bleed valve opening characteristics may be determined based on the calculated results obtained by the lever operation amount and the control valve opening characteristics.

The acceleration/deceleration characteristic control unit 300 controls the opening area of the bleed valve 177 by changing the bleed valve opening characteristics depending on the work mode selected by the work mode selection dial 32. For example, as illustrated in FIGS. 4 to 6, the acceleration/deceleration characteristic control section 300 makes the opening area of the bleed valve 177 in the "ECO mode" setting larger than the opening area of the bleed valve 177 in the "STD mode" setting when the lever operation amount is the same. This is for increasing the bleed flow rate and reducing the actuator flow rate. This can slow down the responsiveness of the operating device 26 to the lever operation and reduce the acceleration/deceleration characteristics. Meanwhile, when the lever operation amount is the same, the acceleration/deceleration characteristic control unit 300 makes the opening area of the bleed valve 177 in the "POWER mode" setting smaller than the opening area of the bleed valve 177 in the "STD mode" setting. This is for reducing the bleed flow rate and increasing the actuator flow rate. This allows the acceleration/deceleration characteristics to be increased by increasing the responsiveness of the control device 26 in response to the lever operation. The bleed valve opening characteristic may be different for each operation mode in a portion of the operation area of the lever operation amount, for example, as illustrated in FIG. 4, and may be different for each operation mode in a part of the operation area of the lever operation amount, for example, as illustrated in FIGS. 5 and 6. The bleed opening characteristics are set so that the opening area changes rapidly with respect to the amount of change in lever operation in the area where the lever operation amount is small. On the other hand, in the area where the lever operation amount is large, the opening area is set to change gradually in response to the amount of change in lever operation.

More specifically, the acceleration/deceleration characteristic control unit 300 increases or decreases the opening area of the bleed valve 177 by outputting a control command corresponding to the work mode selected by the work mode selection dial 32 to the proportional valve 31. For example, if the "ECO mode" is selected, the opening area of the bleed valve 177 is increased as illustrated in FIG. 7 by reducing the current command to the proportional valve 31 to reduce the secondary pressure of the proportional valve 31, compared to the case where the "STD mode" is selected. This is for increasing the bleed flow rate and reducing the actuator flow rate. On the other hand, when the "POWER mode" is selected, the opening area of the bleed valve 177 is reduced as illustrated in FIG. 7 by increasing the secondary pressure of the proportional valve 31 by increasing the current command to the proportional valve 31 rather than when the "STD mode" is selected. This is for reducing the bleed flow rate and increasing the actuator flow rate.

Next, the process of controlling the acceleration/deceleration characteristics of the hydraulic actuators by changing the opening area of the bleed valves 177L and 177R will be described. The acceleration/deceleration characteristic control unit 300 repeatedly performs this process at a predetermined control cycle while the shovel is in operation.

First, the acceleration/deceleration characteristic control unit 300 acquires the work mode selected by the work mode selection dial 32 and selects the bleed valve opening characteristic corresponding to the acquired work mode.

Subsequently, the acceleration/deceleration characteristic control unit 300 determines the target current value of the proportional valves 31L1 and 31R1 based on the selected bleed valve opening characteristic and the proportional valve characteristic. In the present embodiment, the acceleration/deceleration characteristic control unit 300 refers to a table regarding the bleed valve opening characteristics and the proportional valve characteristics to determine the target current value of the proportional valves 31L1 and 31R1 that becomes the bleed valve opening area corresponding to the lever operation amount. That is, the target current value varies depending on the work mode.

Thereafter, the acceleration/deceleration characteristic control unit 300 outputs a current command corresponding to the target current value to the proportional valves 31L1 and 31R1. The proportional valves 31L1 and 31R1 increase the secondary pressure acting on the pilot port of the bleed valves 177L and 177R, when receiving a current command corresponding to a target current value determined, for example, referring to a table for "POWER mode" settings. This reduces the opening area of the bleed valves 177L and 177R, reduces the bleed flow rate, and increases the actuator flow rate. As a result, the acceleration/deceleration characteristics can be increased by increasing the responsiveness of the operating device 26 to the lever operation. On the other hand, the proportional valves 31L1 and 31R1 reduce the secondary pressure acting on the pilot ports of the bleed valves 177L and 177R, when receiving a current command corresponding to a target current value determined, for example, referring to a table regarding the "ECO mode" setting. This increases the opening area of the bleed valves 177L and 177R, increases the bleed flow rate, and decreases the actuator flow rate. As a result, the acceleration/deceleration characteristics can be reduced by slowing down the responsiveness of the operating device 26 to the lever operation.

Figure 8:
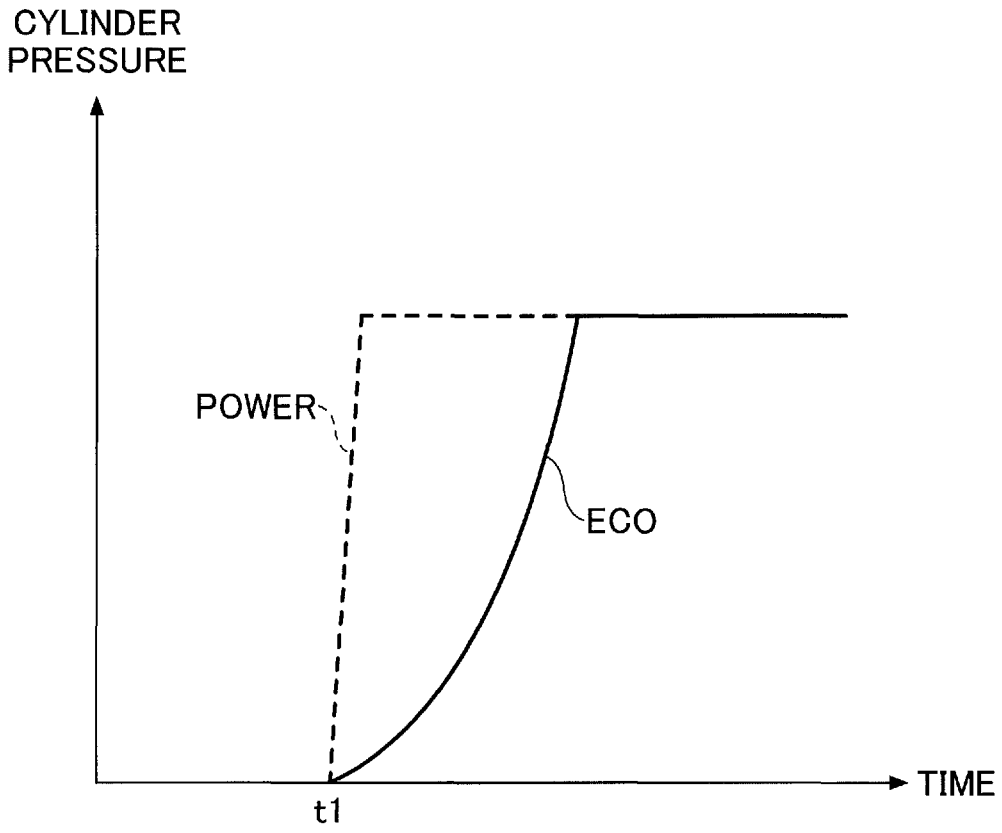
FIG. 8 is a diagram illustrating a temporal transition of a cylinder pressure when a boom is operated.

FIG. 8 is a diagram illustrating a temporal transition of the cylinder pressure when the boom 4 is operated. FIG. 8 illustrates the temporal transition of the cylinder pressure of the boom cylinder 7 in the "ECO mode" setting and the "POWER mode" setting when the boom operation lever 26B is operated by the operator at time t1.

As illustrated in FIG. 8, in the "ECO mode" setting, the period of time until the cylinder pressure of the boom cylinder 7 reaches the target cylinder pressure is longer than the period of time until the cylinder pressure of the boom cylinder 7 reaches the target cylinder pressure in the "POWER mode" setting. That is, in the "ECO mode" setting, the responsiveness in response to the operation of the boom operation lever 26B is slower than the responsiveness in the "POWER mode" setting, and the acceleration/deceleration characteristics are reduced. This allows the hydraulic actuator to be driven without damaging the finishing surface by slowly moving the hydraulic actuator (boom, arm, bucket, and the like) in response to the lever operation when the finishing operation is performed, for example, as in grand leveling work. As a result, even when caution is required, it is possible to improve the operability of the shovel by the operator, to reduce the fatigue of the operator, and further to improve safety.

In the above-described process of controlling the acceleration/deceleration characteristics, the case of increasing or decreasing only the acceleration/deceleration characteristics depending on the selected work mode has been described. However, in addition to the acceleration/deceleration characteristics, the number of revolutions of the engine 11 driving the main pumps 14L and 14R may be increased or decreased. For example, when the "ECO mode" is selected, the RPM of the engine 11 may be decreased, and when the "POWER mode" is selected, the RPM of the engine 11 may be increased.

Figure 9:
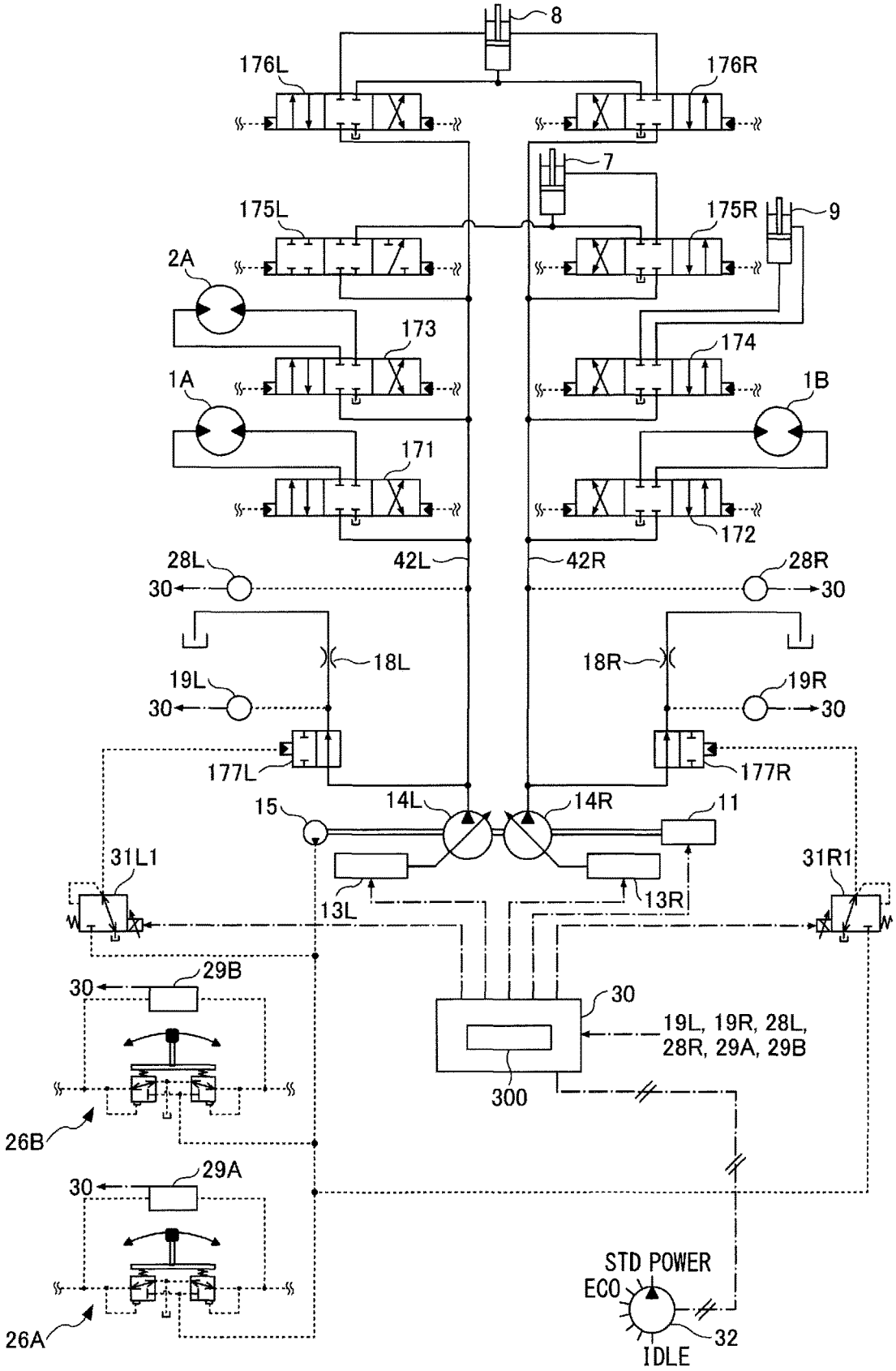
FIG. 9 is a schematic diagram illustrating an modified embodiment of a first configuration of a hydraulic circuit mounted on a shovel of FIG. 1.

Next, an alternative embodiment of the first configuration of the hydraulic circuit mounted on the shovel of FIG. 1 will be described with reference to FIG. 9. FIG. 9 is a schematic diagram illustrating a modification of a first configuration example of a hydraulic circuit mounted on a shovel of FIG. 1. In FIG. 9, similar to FIG. 2, the mechanical power system, the high pressure hydraulic line, the pilot line, and the electrical control system are illustrated by double, solid, dashed, and dashed-dotted lines, respectively.

The hydraulic circuit illustrated in FIG. 9 differs from the hydraulic circuit of the first embodiment illustrated in FIG. 3 in that the bleed valve 177L and the negative control throttle 18L are provided upstream of the conduit 42L and the bleed valve 177R and the negative control throttle 18R are provided upstream of the conduit 42R. Specifically, in the hydraulic circuit illustrated in FIG. 9, the bleed valve 177L and the negative control throttle 18L are provided in a conduit branching off from a position upstream of the control valve 171 provided at the upstream side of the conduit 42L, for example, between the main pump 14L and the discharge pressure sensor 28L. The bleed valve 177R and the negative contour throttle 18R are provided in a conduit branches off from the position of the upstream side of the control valve 172 provided at the upstream side of the conduit 42R, for example, between the main pump 14R and the discharge pressure sensor 28R. The other configuration is similar to the hydraulic circuit of the first example illustrated in FIG. 3, and thus the description thereof will not be repeated. Additionally, the conduits 42L and 42R between the control valves may branch off to discharge the hydraulic oil to the hydraulic oil tank via the bleed valves 177L, 177R and the negative control throttles 18L, 18R.

Figure 10:
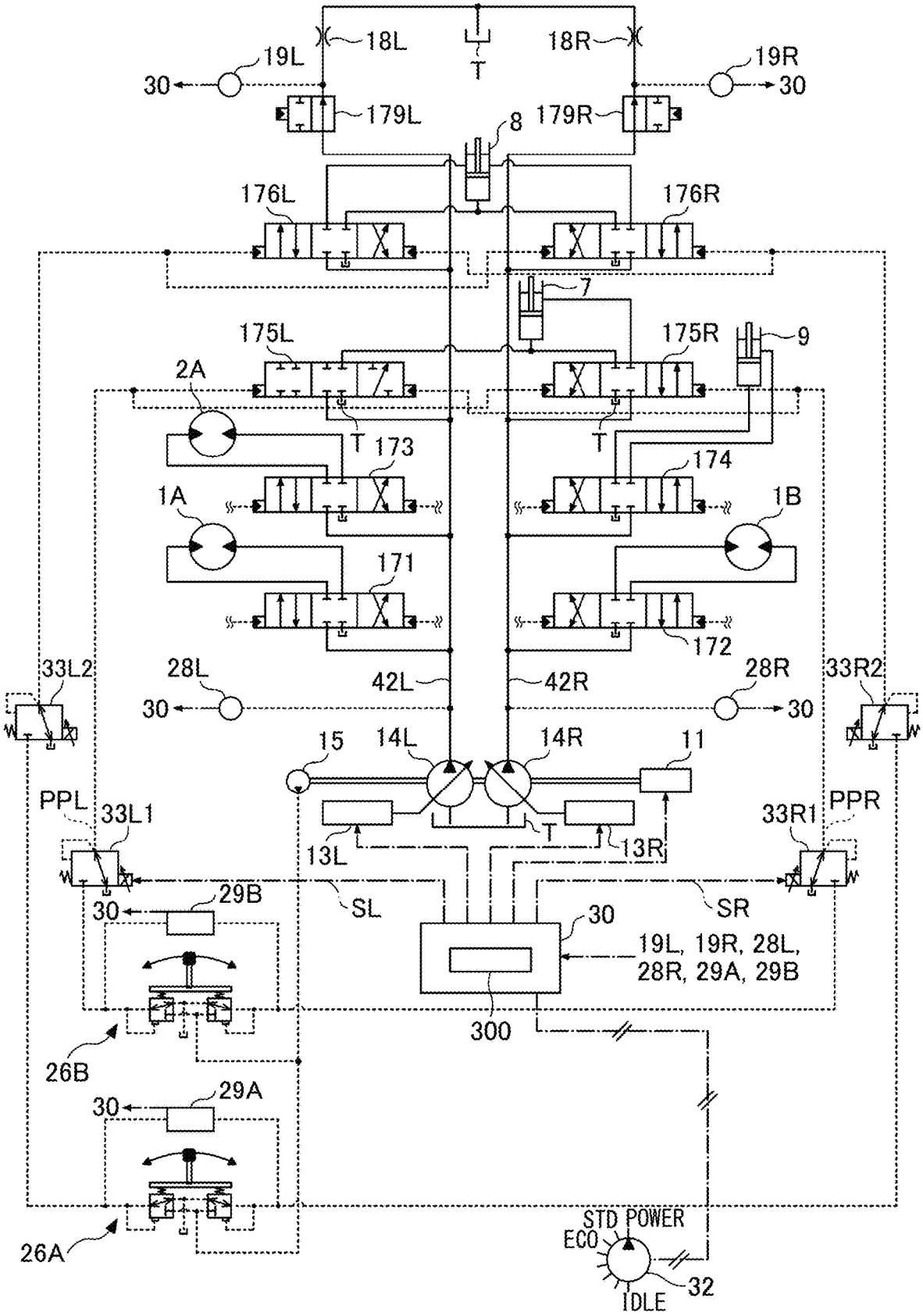
FIG. 10 is a schematic diagram illustrating a second configuration example of a hydraulic circuit mounted on a shovel of FIG. 1.
Figure 11:
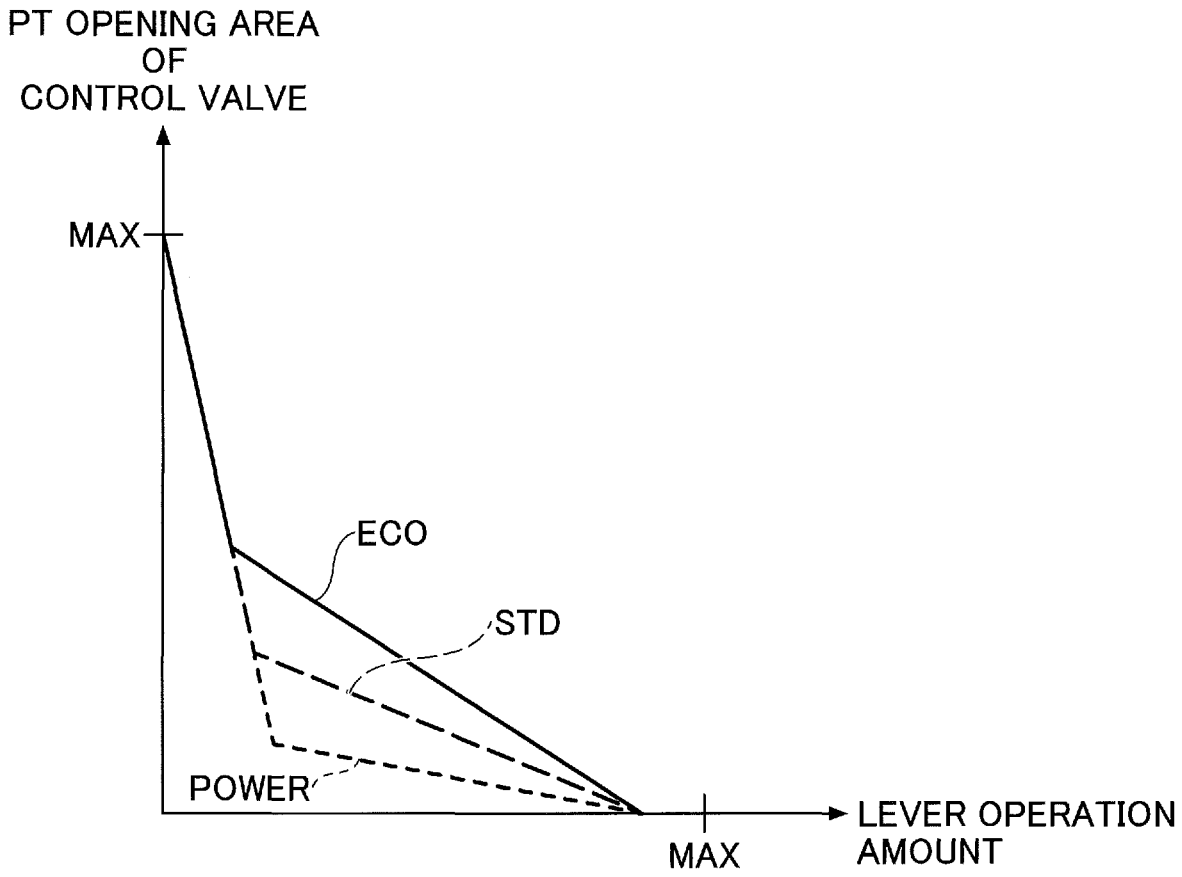
FIG. 11 is a diagram illustrating a relationship between a lever operation amount and a PT opening area of a control valve depending on a work mode.

Referring now to FIGS. 10 and 11, another configuration example of a hydraulic circuit mounted on a shovel of FIG. 1 will be described FIG. 10 is a schematic diagram illustrating a second configuration example of a hydraulic circuit mounted on a shovel of FIG. 1. The hydraulic circuit illustrated in FIG. 10 includes bleed, valves 179L and 179R. The hydraulic circuit illustrated in FIG. 10 includes the pressure reducing valves 33L1, 33R1, 33L2, and 33R2 and does not include the proportional valves 31L1 and 31R1 illustrated in the hydraulic circuit of the first configuration example. The pressure reducing valves 33L1, 33R1, 33L2, and 33R2 serve in the same way as the proportional valves 31L1 and 31R1 do as illustrated in FIG. 3.

Hereinafter, different points from the hydraulic circuit of the first configuration example will be described.

The controller 30 receives outputs from the operation pressure sensors 29A and 29B and the like, outputs a control command to the regulators 13L and 13R as needed, and changes the discharge amount of the main pumps 14L and 14R. The controller 30 also outputs a current command SL and SR to the pressure reducing valves 33L1 and 33R1 to depressurize the secondary pressure PPL and PPR, which are pilot port pressures, introduced to the pilot ports of the control valves 175L and 175R depending on the amount of operation of the boom operation lever 26B. The controller 30 also outputs a current command to the pressure reducing valves 33L2 and 33R2 to depressurize the secondary pressure PPL and PPR, which are the pilot port pressures, introduced to the pilot ports of the control valves 176L and 176R depending on the amount of operation of the arm operation lever 26A.

In the second configuration example, the acceleration/deceleration characteristic control unit 300 of the controller 30 controls the acceleration/deceleration characteristic of the hydraulic actuator by changing the pilot pressure of the pressure reducing valves 33L1 and 33R1 as discussed above, in response to the lever operation (or pedal operation) of the operating device 26 depending on the work mode selected by the work mode selection dial 32, similar to the first configuration example. This can improve the work efficiency of operators, reduce the fatigue of operators, and improve safety.

FIG. 11 is a diagram illustrating a relationship between a lever operation amount depending on a work mode and a PT opening area of a control valve. The PT opening area of the control valve means an opening area between a port communicating with the main pumps 14L and 14R in the control valves 175L and 1758 and a port communicating with the hydraulic oil tank T in the control valves 175L and 175R. The control valves 175L and 175R in FIG. 10 are expressed as a hydraulic circuit, but each of the control valves 175L and 175R includes a spool valve, and the spool valve creates a left side circuit state (all closed state), a right side circuit (all opened state) and a middle side circuit state (partially opened state). In the partially opened state, part of hydraulic oil supplied from the main pumps 14L and 14R goes to the actuator 7 and the rest of the hydraulic oil supplied from the main pump 14L and 14R goes to the tanks T. Thus, the spool valve creates the PT opening area discussed above. Because one skilled in the art would understand the function of the spool valve in the control valves 175L, and 175R, the specific structure is omitted and expresses as a hydraulic circuit in FIG. 10. The relationship between the lever operation amount and the PT opening area of the control valve (hereinafter referred to as "control valve opening characteristics") and the relationship between a current value of the pressure reducing valve and the PT opening area of the control valve (hereinafter referred to as "pressure reducing valve characteristics") may be stored in the ROM as a reference table, for example, or may be expressed by a predetermined calculation formula.

The acceleration/deceleration characteristic control unit 300 controls the PT opening area of the control valve by changing the control valve opening characteristic depending on the work mode selected by the work mode selection dial 32. For example, as illustrated in FIG. 11, the acceleration/deceleration characteristic control unit 300 makes the PT opening area of the control valves 175L and 175R in the "ECO mode" setting larger than the PT opening area of the control valves 175L and 175R in the "STD mode" setting when the lever operation amount is the same. This is because in the "ECO mode," the flow rate of the hydraulic oil flowing into the hydraulic oil tank is increased to reduce the flow rate of the hydraulic oil flowing into the boom cylinder 7. This can slow down the responsiveness of the operating device 26 in response to the lever operation and reduce the acceleration/deceleration characteristics. Meanwhile, when the lever operation amount is the same, the acceleration/deceleration characteristic control unit 300 makes the PT opening area of the control valves 175L and 175R in the "POWER mode" setting smaller than the PT opening area of the control valves 175L and 175R in the "STD mode" setting. This is because in the "POWER mode," the flow rate of the hydraulic oil flowing into the hydraulic oil tank is reduced to increase the flow rate of the hydraulic oil flowing into the boom cylinder 7. This allows the acceleration/deceleration characteristics to be increased by increasing the responsiveness of the operating device 26 in response to the lever operation. As illustrated in FIG. 11, the control valve opening characteristics may differ for each operation mode in a part of the operational range of the lever operation amount, or may differ for each operation mode in all the operation range of the lever operation amount, similar to the bleed valve opening characteristics in the first configuration example.

More specifically, the acceleration/deceleration characteristic control unit 300 increases or decreases the PT opening area of the control valves 175L and 175R by outputting, for example, a control command corresponding to the work mode selected by the work mode selection dial 32 to the pressure reduction valves 33L1 and 33R1. For example, when the "ECO mode" is selected, the PT opening area of the control valves 175L and 175R is increased by decreasing the current command for the pressure reducing valves 33L1 and 33R1 and reducing the secondary pressure of the pressure decreasing valves 33L1 and 33R1, compared to the case where the "STD mode" is selected. On the other hand, when the "POWER mode" is selected, the PT opening area of the control valves 175L and 175R is decreased by increasing the current command for the pressure reducing valves 33L1 and 33R1 and increasing the secondary pressure of the pressure reducing valves 33L1 and 33R1, rather than when the "STD mode" is selected.

The acceleration/deceleration characteristic control unit 300 increases or decreases the PT opening area of the control valves 176L and 176R by outputting, for example, a control command corresponding to the work mode selected by the work mode selection dial 32 to the pressure reduction valves 33L2 and 33R2. For example, when the "ECO mode" is selected, the PT opening area of the control valves 176L and 176R is increased by decreasing the current command for the pressure reducing valves 33L2 and 33R2 and decreasing the secondary pressure of the pressure reducing valves 33L2 and 33R2, compared to the case where the "STD mode" is selected. On the other hand, in the case of the "POWER mode," the PT opening area of the control valves 176L and 176R is decreased by increasing the current command for the pressure reduction valves 33L2 and 33R2 and increasing the secondary pressure of the pressure reduction valves 33L2 and 33R2, rather than in the case of the "STD mode."

Next, the process of controlling the acceleration/deceleration characteristics of the hydraulic actuator by adjusting the pilot pressure acting on the control valves 175L and 175R by the acceleration/deceleration characteristic control unit 300 will be described. The acceleration/deceleration characteristic control unit 300 repeatedly performs this process at a predetermined control cycle while the shovel is in operation.

First, the acceleration/deceleration characteristic control unit 300 acquires the work mode selected by the work mode selection dial 32 and selects the control valve opening characteristic corresponding to the acquired work mode.

Subsequently, the acceleration/deceleration characteristic control unit 300 determines the target current values of the pressure reducing valves 33L1 and 33R1 based on the selected control valve opening characteristic and the pressure reducing valve characteristic. In the present embodiment, the acceleration/deceleration characteristic control section 300 refers to a table regarding the control valve opening characteristics and the pressure reducing valve characteristics, and determines the target current value of the pressure reducing valves 33L1 and 33R1 that are the PT opening area of the control valve corresponding to the lever operation amount. That is, the target current value varies depending on the work mode.

Thereafter, the acceleration/deceleration characteristic control unit 300 outputs a current command corresponding to the target current value to the pressure reducing valves 33L1 and 33R1. The pressure reducing valves 33L1 and 33R1 reduce the secondary pressure acting on the pilot ports of the control valves 175L and 175R when receiving a current command corresponding to a target current value determined with reference to a table regarding the "ECO mode" setting. This increases the PT opening area of the control valves 175L and 175R, increases the flow rate of the hydraulic oil flowing into the hydraulic oil tank, and decreases the flow rate of the hydraulic oil flowing into the boom cylinder 7. As a result, the acceleration/deceleration characteristics can be decreased by slowing down the responsiveness of the operating device 26 in response to the lever operation. On the other hand, the pressure reducing valves 33L1 and 33R1 increase the secondary pressure acting on the pilot ports of the control valves 175L and 175R when receiving a current command corresponding to a target current value determined with reference to a table regarding the "POWER mode" setting. Accordingly, because the opening area of the pressure reducing valves 33L1 and 33R1 is decreased, the flow rate of the hydraulic oil flowing into the hydraulic oil tank is decreased, and the flow rate of the hydraulic oil flowing into the boom cylinder 7 is increased. As a result, the acceleration and deceleration characteristics can be increased by increasing the responsiveness of the control device 26 in response to the lever operation.

In the above-described process of controlling the acceleration/deceleration characteristics, the case of increasing or decreasing only the acceleration/deceleration characteristic depending on the selected work mode has been described. However, in addition to the acceleration/deceleration characteristics, the number of revolutions of the engine 11 driving the main pumps 14L and 14R may be increased or decreased. For example, when the "ECO mode" is selected, the RPM of the engine 11 may be reduced, and when the "POWER mode" is selected, the RPM of the engine 11 may be increased. Here, the bleed valves 177L and 177R are determined to have the bleed valve opening characteristics based on the calculation results obtained by the lever operation amount and the control valve opening characteristics.

As a result, the operation of each hydraulic actuator corresponding to the acceleration/deceleration characteristic determined in the work mode and the amount of lever operation can be implemented, and good operability can be obtained.

Also, the lever operation amount and the control valve opening characteristics can be applied to various patterns, as well as the lever operation amount and bleed valve opening characteristics illustrated in FIGS. 3 to 6, without being limited to the characteristics illustrated in FIG. 11.

Despite the above description of the embodiments of the present invention, the above description is not intended to limit the content of the invention, and various alternations and modifications can be made within the scope of the present invention.

For example, in FIGS. 3, 9 and 10, the respective control valves 171, 173, 175L and 176L, which control the flow of hydraulic oil from the main pump 14L to the hydraulic actuator, are connected in parallel with each other between the main pump 14L and the hydraulic oil tank. However, the control valves 171, 173, 175L and 176L may be each connected in series between the main pump 14L and the hydraulic oil tank. In this case, the conduit 42L can supply the hydraulic oil to adjacent control valves located downstream, without being interrupted by a spool, even if the spool including each control valve has been switched to any valve position.

Similarly, the respective control valves 172, 174, 175R and 176R, which control the flow of hydraulic oil from the main pump 14R to the hydraulic actuator, are connected in parallel with each other between the main pump 14R and the hydraulic oil tank. However, each of the control valves 172, 174, 175R and 176R may be connected in series between the main pump 14R and the hydraulic oil tank. In this case, the conduit 42R can supply the hydraulic oil to adjacent control valves positioned downstream without being interrupted by a spool, even if the spools that include each control valve have been switched to any valve position.

Figure 12:
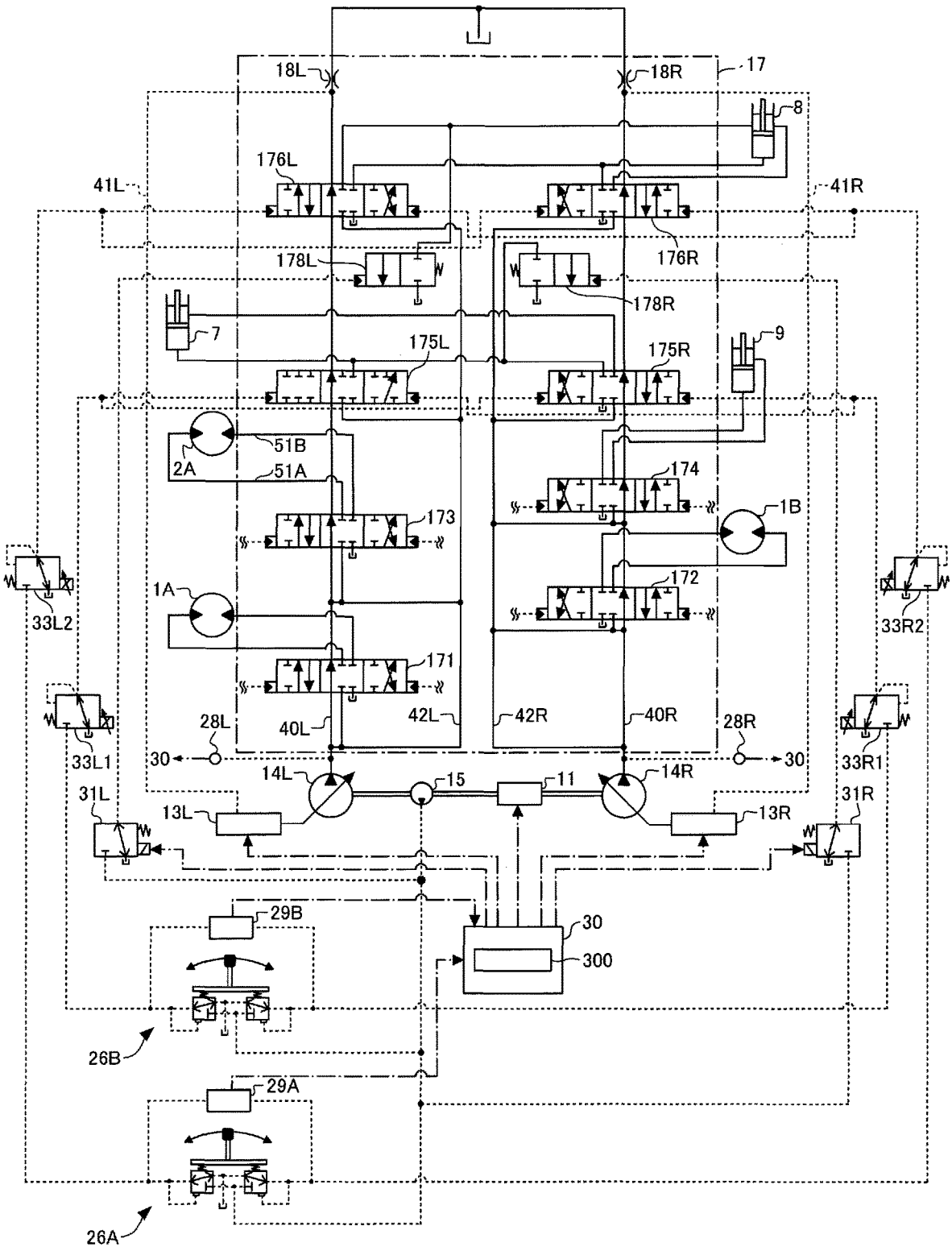
FIG. 12 is a schematic diagram illustrating another example of a hydraulic circuit to be mounted on a shovel of FIG. 1.

Alternatively, the control valves 171, 173, 175L, and 176L may be each connected in series between the main pump 14L and the hydraulic oil tank, and the control valves 172, 174, 175R, and 176R may be each connected in series between the main pump 14R and the hydraulic oil tank, for example having center bypass conduits 40L, 40R, and parallel conduits 42L, 42R, as illustrated in FIG. 12. FIG. 12 is a schematic diagram illustrating another example of a hydraulic circuit mounted on a shovel of FIG. 1. In FIG. 12, similar to FIG. 2, the mechanical power system, the high pressure hydraulic line, the pilot line, and the electrical control system are illustrated by double, solid, dashed, and dashed and dotted lines, respectively.

The hydraulic system illustrated in FIG. 12 circulates the hydraulic oil from the main pumps 14L, 14R driven by the engine 11 to the hydraulic oil tank via center bypass conduits 40L, 40R, and parallel conduits 42L, 42R.

The center bypass conduit 40L is a high pressure hydraulic line passing through control valves 171, 173, 175L and 176L disposed within the control valve 17.

The center bypass conduit 40R is a high pressure hydraulic line passing through control valves 172, 174, 175R and 176R disposed within the control valve 17.

The control valve 178L is a spool valve that controls the flow rate of the hydraulic oil flowing from the rod side oil chamber of the arm cylinder 8 to the hydraulic oil tank. The control valve 178R is a spool valve that controls the flow rate of the hydraulic oil flowing from the bottom side oil chamber of the boom cylinder 7 to the hydraulic oil tank. The control valves 178L and 178R have a first valve position with a minimum opening area (0% opening) and a second valve position with a maximum opening area (100% opening). The control valves 178L, 178R are movable between the first and second valve positions in a stepless manner. The control valves 178L and 178R are controlled by the pressure control valves 31L and 31R, respectively.

The parallel conduit 42L is a high pressure hydraulic line parallel to the center bypass conduit 40L. The parallel conduit 42L supplies the hydraulic oil to the lower control valve when the flow of hydraulic oil passing through the center bypass conduit 40L is restricted or interrupted by either the control valves 171, 173, 175L.

The parallel conduit 42R is a high pressure hydraulic line parallel to the center bypass conduit 40R. The parallel conduit 42R supplies hydraulic oil to the downstream control valve when the flow of hydraulic oil through the center bypass conduit 40R is restricted or interrupted by either of the control valves 172, 174, and 175R.

Figure 13:
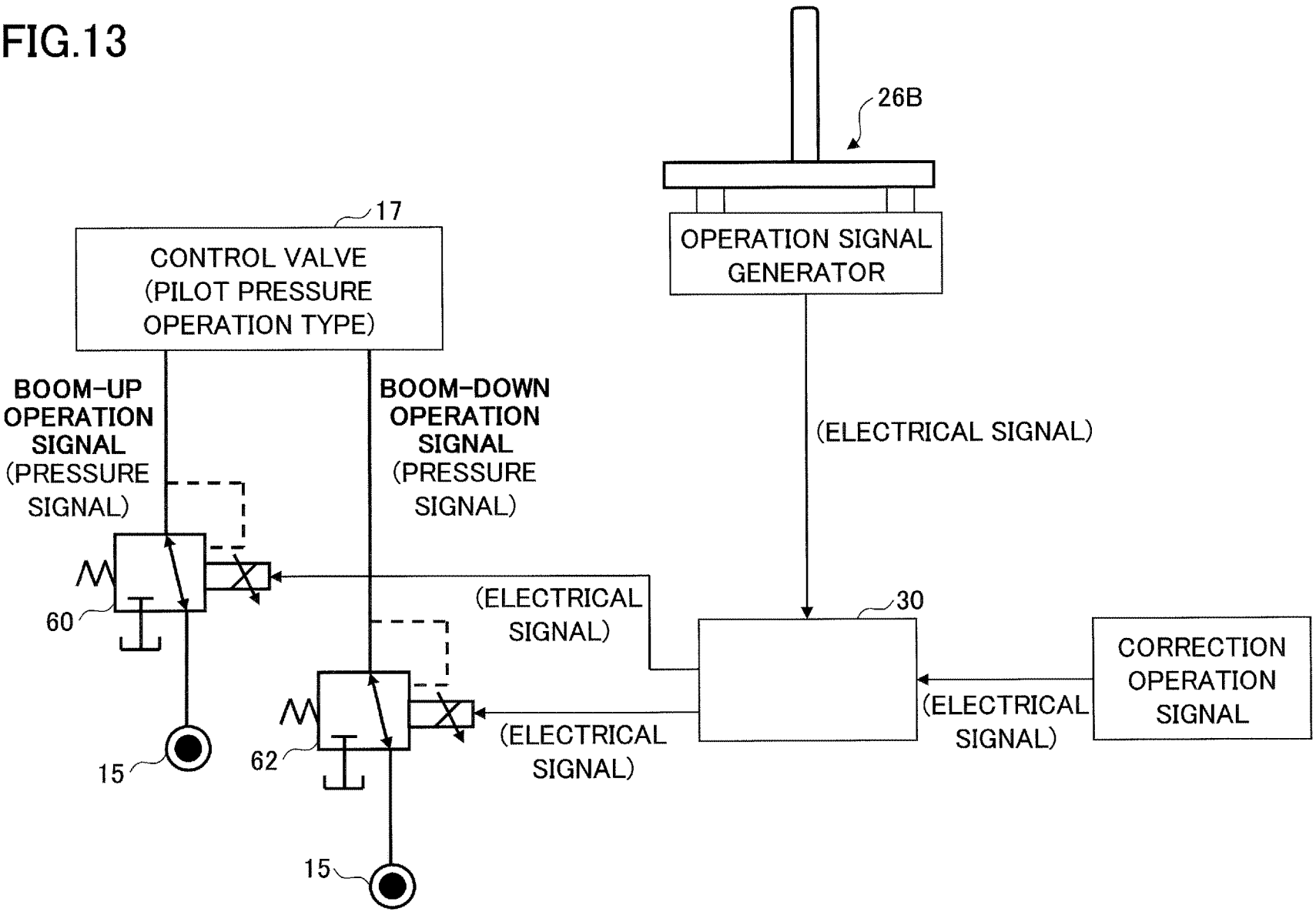
FIG. 13 is a diagram illustrating an example of a configuration of an operation system including an electrical operating device.

In the embodiments described above, a hydraulic actuator is employed as the actuator 26, although an electric actuator may be employed. FIG. 13 illustrates an example of a configuration of an operation system including an electrical actuator. Specifically, the operation system shown in FIG. 13 is an example of a boom operation system. The boom operation system mainly includes a pilot pressure operated control valve 17, a boom operation lever 26B as an electric operation lever, a controller 30, a solenoid valve 60 for a boom up operation, and a solenoid valve 62 for a boom down operation. The operating system of FIG. 13 may be also applied to an arm operating system, a bucket operating system and the like.

The pilot pressure operated control valve 17 includes control valves 175L and 175R for the boom cylinder 7, as illustrated in FIG. 3. The solenoid valve 60 is configured to adjust the flow path area of the oil passage that drives the pilot pump 15 and the right-side (raising-side) pilot port of the control valve 175L and the left-side (raising-side) pilot port of the control valve 175R. The solenoid valve 62 is configured to adjust the flow path area of the oil passage for the pilot pump 15 and the right-side (lowering-side) pilot port of the control valve 175R.

When manual operation is performed, the controller 30 generates a boom-up operation signal (electrical signal) or a boom-down operation signal (electrical signal) in response to an operation signal (electrical signal) output by the operation signal generator of the boom operation lever 26B. The operation signal output from the operation signal generator of the boom operation lever 26B is an electrical signal that varies depending on the operation amount and the direction of the boom operation lever 26B.

Specifically, when the boom operation lever 26B is operated in the boom raising direction, the controller 30 outputs a boom-up operation signal (an electrical signal) depending on the amount of lever operation to the solenoid valve 60. The solenoid valve 60 adjusts the flow passage area in response to the boom-up operation signal (electrical signal) and controls the pilot pressure acting on the right-side (raising-side) pilot port of the control valve 175L and the left-side (raising-side) pilot port of the control valve 175R. Similarly, when the boom operation lever 26B is operated in the boom down direction, the controller 30 outputs a boom-down operation signal (electrical signal) corresponding to the lever operation amount to the solenoid valve 62. The solenoid valve 62 adjusts the flow passage area in response to a boom-down operation signal (electrical signal) to control the pilot pressure acting on the right-side (lowering-side) pilot port of the control valve 175R.

When automatic control is performed, the controller 30 generates a boom-up operation signal (electrical signal) or a boom-down operation signal (electrical signal) in response to the correction operation signal (electrical signal) instead of the operation signal output by the operation signal generator of the boom operation lever 26B. The correction operation signal may be an electrical signal generated by the controller 30 or an electrical signal generated by an external controller other than the controller 30.

As discussed above, embodiments of the present invention can provide a shovel capable of controlling acceleration/deceleration characteristics depending on a work mode.

What is claimed is:

1. A shovel, comprising:

a lower traveling body;

an upper turning body pivotally mounted on the lower traveling body;

a drive source mounted on the upper turning body;

a first hydraulic pump driven by the drive source and mounted on the upper turning body;

a second hydraulic pump driven by the drive source and mounted on the upper turning body, a first bleed valve disposed in a first conduit into which the first hydraulic pump discharges hydraulic oil;

a second bleed valve disposed in a second conduit into which the second hydraulic pump discharges hydraulic oil;

a plurality of hydraulic actuators respectively corresponding to a boom, an arm, and a bucket, and driven by the hydraulic oil discharged from at least one of the first hydraulic pump and the second hydraulic pump;

a plurality of operating devices corresponding to the boom, the arm, and the bucket, for operating the plurality of hydraulic actuators; and a control device configured to control a plurality of acceleration/deceleration characteristics of the hydraulic actuators in response to the operations of the operating devices depending on work modes and amounts of respective operations of the plurality of operating devices, wherein the control device controls the acceleration/deceleration characteristics by changing opening areas of the first bleed valve and the second bleed valve and a setting condition of the drive source, depending on the work modes and amounts of respective operations of at least one of the plurality of operating devices.

2. The shovel as claimed in claim 1, wherein the control device decreases the acceleration/deceleration characteristic from the acceleration/deceleration characteristic in a first mode of the work modes and a number of rotations of the drive source configured to drive the at least one the first hydraulic pump and the second hydraulic pump, from a number of rotations in the first mode, when a second mode of the work modes is selected.

3. The shovel as claimed in claim 1, wherein the first bleed valve and the second bleed valve are configured to control a flow rate of the hydraulic oil flowing to a hydraulic oil tank without passing through the hydraulic actuator of the hydraulic oil discharged from the first hydraulic pump and the second hydraulic pump, respectively.

4. The shovel as claimed in claim 3, wherein the control device changes the opening areas of the first bleed valve and the second bleed valve based on opening characteristics determined depending on the work modes showing a relationship between an operation amount of the operating device and the opening areas of the first bleed valve and the second bleed valve, the opening areas of the first bleed valve and the second bleed valve in the second mode being set greater than that those of the first mode when the operations of the plurality of operating devices are not changed.

5. The shovel as claimed in claim 1, further comprising:

a first control valve configured to control a flow of the hydraulic oil flowing from the first hydraulic pump toward the hydraulic actuator; and a second control valve configured to control a flow of the hydraulic oil flowing from the second hydraulic pump toward the hydraulic actuator.

6. The shovel as claimed in claim 5, wherein the control device controls the acceleration/declaration characteristics using an electromagnetic proportional valve.

7. The shovel as claimed in claim 6, wherein the electromagnetic proportional valve includes first and second electromagnetic proportional valves both disposed for one of the bleed valves.

* * * * *